US011441761B2

(12) United States Patent
Yang et al.

(10) Patent No.: US 11,441,761 B2
(45) Date of Patent: Sep. 13, 2022

(54) TRACK ADAPTER AND THE DRIVING POWER SUPPLY AND TRACK LIGHT THEREOF

(71) Applicants: Self Electronics Co., Ltd., Zhejiang (CN); Wanjiong Lin, Zhejiang (CN); Self Electronics USA Corporation, Norcross, GA (US)

(72) Inventors: Jun Yang, Ningbo (CN); Jianguo Dong, Ningbo (CN); Liang Ying, Zhejiang (CN); Biao Wang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 17/305,003

(22) Filed: Jun. 29, 2021

(65) Prior Publication Data

US 2022/0186918 A1 Jun. 16, 2022

(30) Foreign Application Priority Data

Dec. 16, 2020 (CN) ..... 202011488890.7

(51) Int. Cl.

| | |
|---|---|
| ***F21V 21/35*** | (2006.01) |
| ***F21V 21/02*** | (2006.01) |
| ***F21V 23/00*** | (2015.01) |
| ***F21V 23/02*** | (2006.01) |
| ***H01R 25/14*** | (2006.01) |

(Continued)

(52) U.S. Cl.

CPC ..... *F21V 21/35* (2013.01); *F21V 21/025* (2013.01); *F21V 23/006* (2013.01); *F21V 23/009* (2013.01); *F21V 23/02* (2013.01); *F21V 23/023* (2013.01); *H01R 13/71* (2013.01); *H01R 25/142* (2013.01); *H01R 25/145* (2013.01); *H01R 24/38* (2013.01)

(58) Field of Classification Search

CPC ..... F21V 21/34; F21V 21/35; F21V 21/025; F21V 23/02; F21V 23/023; F21V 23/004; F21V 23/006; F21V 23/007; F21V 23/009; H01R 25/142; H01R 25/145; H01R 24/38; H01R 13/71

See application file for complete search history.

(56) References Cited

U.S. PATENT DOCUMENTS

2021/0025557 A1* 1/2021 Leonardo ..... F21S 8/068

FOREIGN PATENT DOCUMENTS

DE 202018003149 U1 * 9/2018 ..... F21V 21/34
EP 3544127 A1 * 9/2019 ..... F21V 21/35

(Continued)

*Primary Examiner* — Alan B Cariaso
(74) *Attorney, Agent, or Firm* — Wang Law Firm, Inc.

(57) ABSTRACT

A track adapter has a mounting seat, an electrical supply column, an adjustment conductive portion, and an adjustment knob, and a drive mechanism. As to the track adapter and the driving power supply with the track adapter and the track light, the lamp holder of the track lamp can wrap the whole track, which is neat and beautiful, and solve the problem of difficult phase adjustment of adaptor in the prior art at the same time. The phase adjustment knob is shrunk and put on the top of the adaptor, which solves the adjustment problem and adapts to more occasions, so that the structural design of the track lamp is more flexible.

17 Claims, 10 Drawing Sheets

(51) Int. Cl.
*H01R 13/71* (2006.01)
*H01R 24/38* (2011.01)

(56) References Cited

FOREIGN PATENT DOCUMENTS

WO WO-2021116939 A1 * 6/2021 ..... H01R 13/641
WO WO-2021122844 A1 * 6/2021 ..... F21V 17/164

* cited by examiner

TRACK ADAPTER AND THE DRIVING POWER SUPPLY AND TRACK LIGHT THEREOF

RELATED APPLICATION

This application claims priority to a Chinese Patent Application No. CN 202011488890.7, filed on Dec. 16, 2020.

FIELD OF THE TECHNOLOGY

The present invention relates to the field of track illumination, in particular with a track adapter, a driving power supply and a track light with the adapter.

BACKGROUND OF THE INVENTION

The track light is a lamp mounted on the track, and the track adapter thereof is mounted in the matching track. There are conductive metal strips on both sides within the track, and the track adapter is provided with rotatable conductive metal sheets. The conductive metal sheets on the track light contact the conductive metal strips within the track when mounting, the track light is powered, that is, the track light can be light.

In order to realize the track light with different power supply modes and multiple lines and circuits, it is necessary to provide a plurality of conductive metal sheets and set a phase adjustment portion to adjust the conduct between the conductive metal sheet and the track light to make the track light and different conductive metal strips within the track, the output of the phase adjustment portion is connected to the driving power supply to supply power to the track light.

However, the phase adjustment portion of the traditional track adapter is placed at the bottom of the adapter. After it was installed to the track, some parts are exposed to the outside of the track, which is not beautiful in appearance and increases the cost.

BRIEF SUMMARY OF THE INVENTION

In view of this, the present invention provides a track adapter and a driving power supply and a track light with the adapter to solve the above technical problems.

A track adapter, comprising:

a mounting seat, having a first central axis;

an electrical supply column, rotated around the first central axis and arranged on the mounting seat, and provided with a negative electrode conductive sheet and at least two positive electrode conductive sheets on its column body, and the positive electrode conductive sheet extends to the bottom of the electrical supply column forming a positive electrode contact, and the positive electrode contacts are arranged around the first central axis at intervals;

characterized in that, it further comprising:

an adjustment conductive portion, located at the bottom of the electrical supply column, and rotated around the first central axis and arranged on the mounting seat, and provided with a conductive contact in flexible connection with the bottom of the electrical supply column, and the moving path of the conductive contact passes through the positive electrode contacts;

an adjustment knob, which is rotatable and arranged on the mounting seat and located on the outside of the top of the electrical supply column;

a drive mechanism, which is used to realize the drive connection between the adjustment knob and the adjustment conductive portion.

advantageously, the adjustment conductive portion further comprises a positive electrode conductive connector, which maintains a constant conduction with the conductive contact;

a negative electrode conductive connector, which is in conduction with the negative electrode conductive sheet when the negative electrode conductive sheet is rotated to the position connected with the track.

advantageously, the mounting seat is provided with a second central axis parallel to the first central axis, the drive mechanism includes:

a first drive gear, which is located at the bottom of the electrical supply column and fixedly connected to the adjustment conductive portion, and its gear shaft is coincident with the first central axis;

a second drive gear, which is engaged with the first drive gear and is rotatable around the second central axis and arranged on the mounting seat, and the adjustment knob is fixed to the second drive gear.

advantageously, the bottom of the electrical supply column is radially expanded to form a conductive plate. The positive electrode contact is a sheet attached to the bottom surface of the conductive plate, and the conductive contact abuts against the bottom surface of the conductive plate.

advantageously, the negative electrode conductive sheet extends to the bottom of the electrical supply column to form a negative electrode contact.

advantageously, the adjustment conductive portion comprises:

an adjustment plate, provided with a shaft hole in the middle, and the plate surface of the adjustment plate is face against to the positive electrode contact on the bottom surface of the conductive plate and a through hole is provided on the plate surface. The middle of the bottom surface of the conductive plate is provided with a rotating shaft that cooperates with the shaft hole;

and an annular conductive plate, which is arranged on the bottom surface of the adjustment plate, being with a conductive shrapnel passing through the through hole as the conductive contact thereon.

advantageously, there are three positive electrode conductive sheets.

advantageously, the electrical supply column is provided with a protruding rotating handle.

A driving power supply comprising a power supply housing and a circuit board disposed in the power supply housing, the mounting seat is fixed to the power supply housing, the positive electrode conductive connector is connected to the positive input end of the circuit board, and the negative electrode conductive connector is connected to the negative input end of the circuit board.

advantageously, the mounting seat, the adjustment column, the adjustment conductive portion and the drive mechanism are disposed in the power supply housing. The top of the power supply housing is provided with a mounting hole for the adjustment knob passing through, and at least one side of the power supply housing is provided with an electrical supply hole that is provided for the negative electrode conductive sheet and the positive electrode conductive sheet passing through.

advantageously, there are three positive electrode conductive sheets, which is grouped together in pairs with the negative electrode conductive sheet and arranged on both sides of the electric column. The power supply housing is provided with an electrical supply hole on both sides.

A track light comprises a lamp holder, a light source assembly, a driving power supply, and a track adapter.

advantageously, the lamp holder driving power supply includes a power supply housing and a circuit board disposed in the power supply housing, the mounting seat is fixed to the power supply housing, the positive electrode conductive connector is connected to the positive input end of the circuit board, and the negative electrode conductive connector is connected to the negative input end of the circuit board.

advantageously, the lamp holder includes a U-profile with opening upward and an end cover provided at both ends of the U-profile. The light source assembly is arranged on the outer side of the U-profile, the track adapter is arranged in the bottom of the U-profile; the end cover is provided with a notch that avoids the track.

advantageously, the power supply housing comprises a lower portion and an upper portion inserted into the track. The mounting seat, a electrical supply column, and the adjustment conductive portion and the drive mechanism are disposed in the power supply housing; The top of the upper portion is provided with a mounting hole for the adjustment knob exposing, and the two sides are provided with the electrical supply hole that provided for the negative electrode conductive sheet and the positive electrode conductive sheet passing through.

advantageously, the width of the lower portion is greater than the upper portion, for facilitating the drive mechanism, for receiving the mounting seat, the drive mechanism.

advantageously, the electrical supply column is provided with a rotating handle extending out of the power supply housing, and the side wall of the U-profile is provided with a strip hole where the rotating handle passes through.

The technical effects of the present invention:

As to the track adapter and the driving power supply with the track adapter and the track light of the present invention, the lamp holder of the track lamp can wrap the whole track, which is neat and beautiful, and solve the problem of difficult phase adjustment of adaptor in the prior art at the same time. The phase adjustment knob is shrunk and put on the top of the adaptor, which solves the adjustment problem and adapts to more occasions, so that the structural design of the track lamp is more flexible.

BRIEF DESCRIPTION OF THE DRAWINGS

Embodiments of the present invention will be described below with reference to the drawings, in which.

DETAILED DESCRIPTION OF THE INVENTION

A specific embodiment of the present invention will be further described below based on the drawings. It should be understood that the description of the embodiments of the present invention is not intended to limit the scope of the invention.

Figure 1:
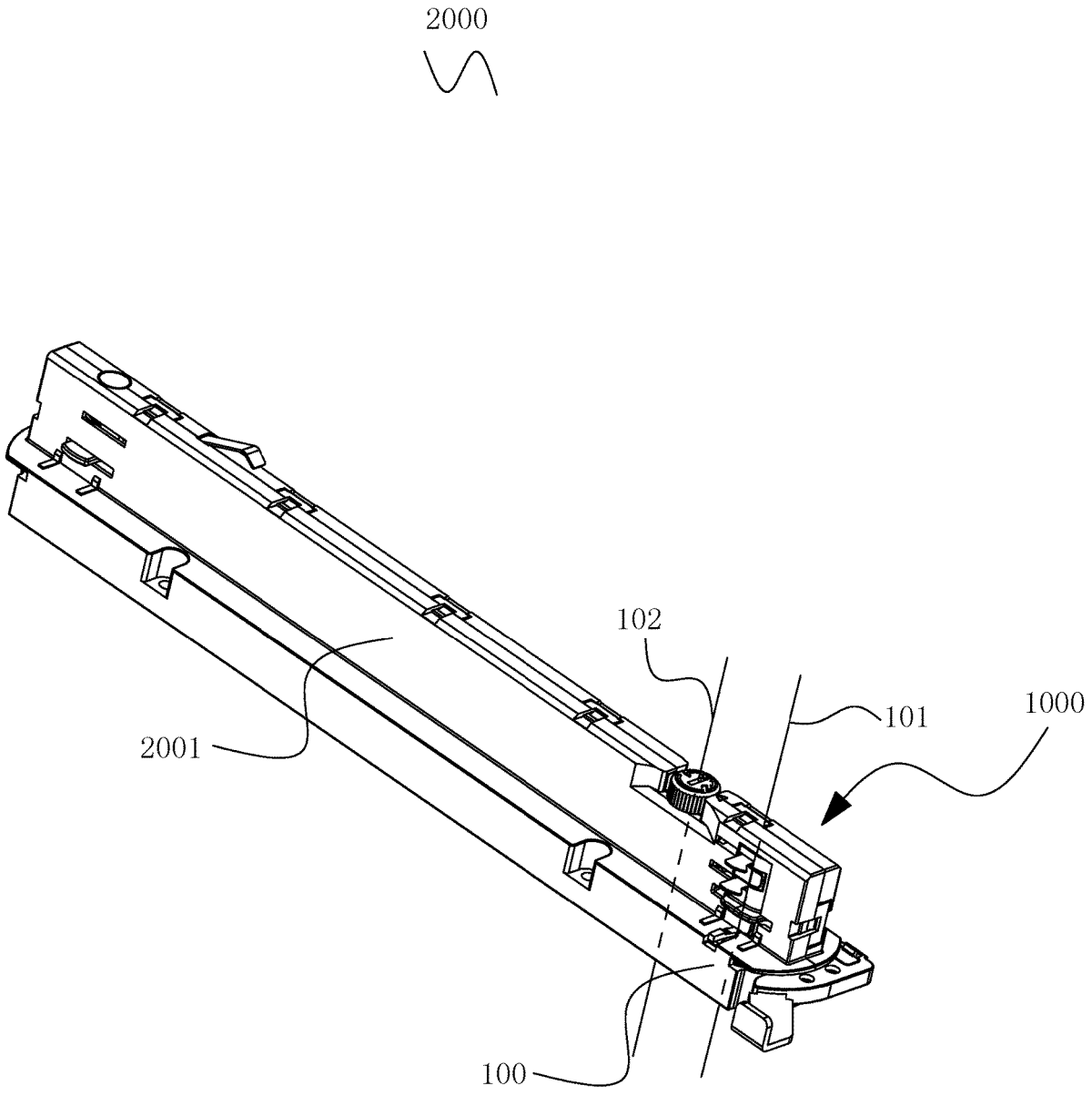
FIG. 1 is a schematic structural diagram of the driving power supply of the present embodiment.
Figure 2:
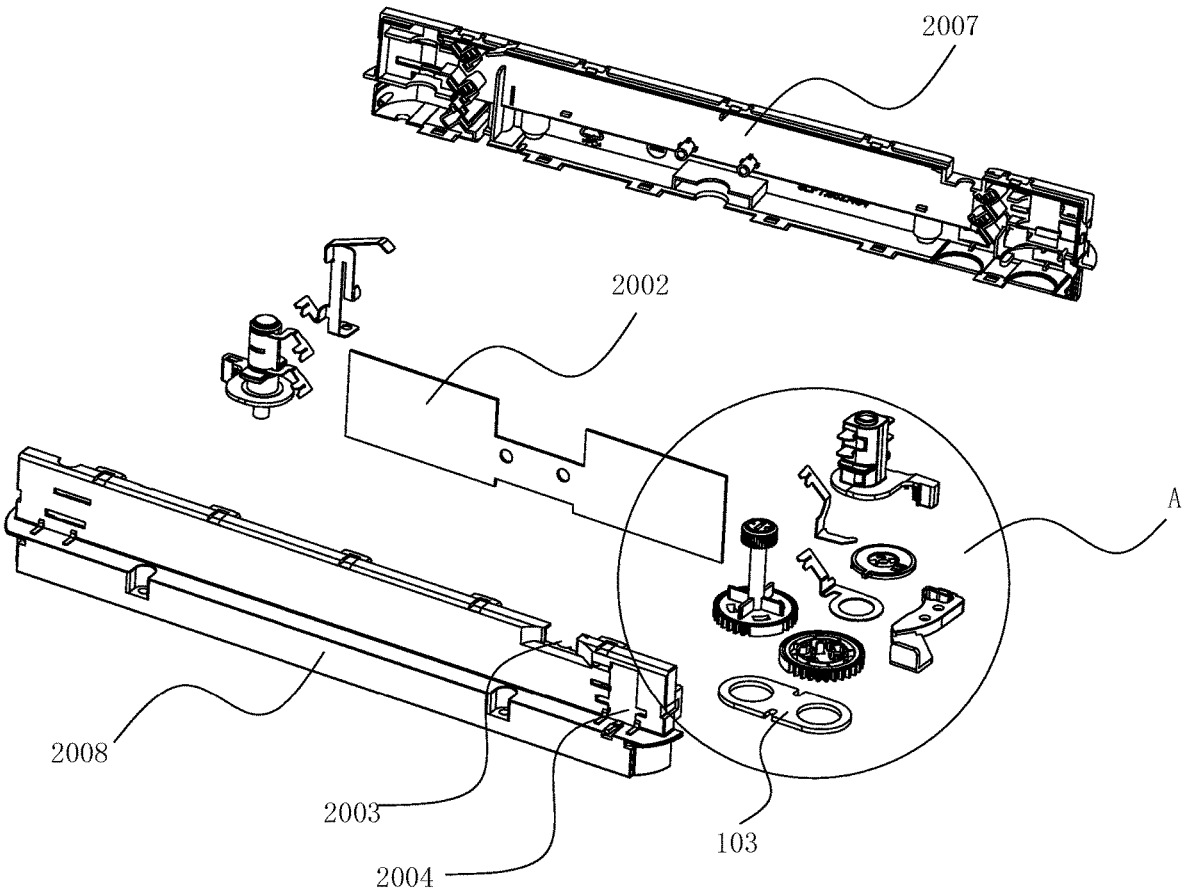
FIG. 2 is an explosive structure of the driving power supply of the present embodiment.
Figure 3:
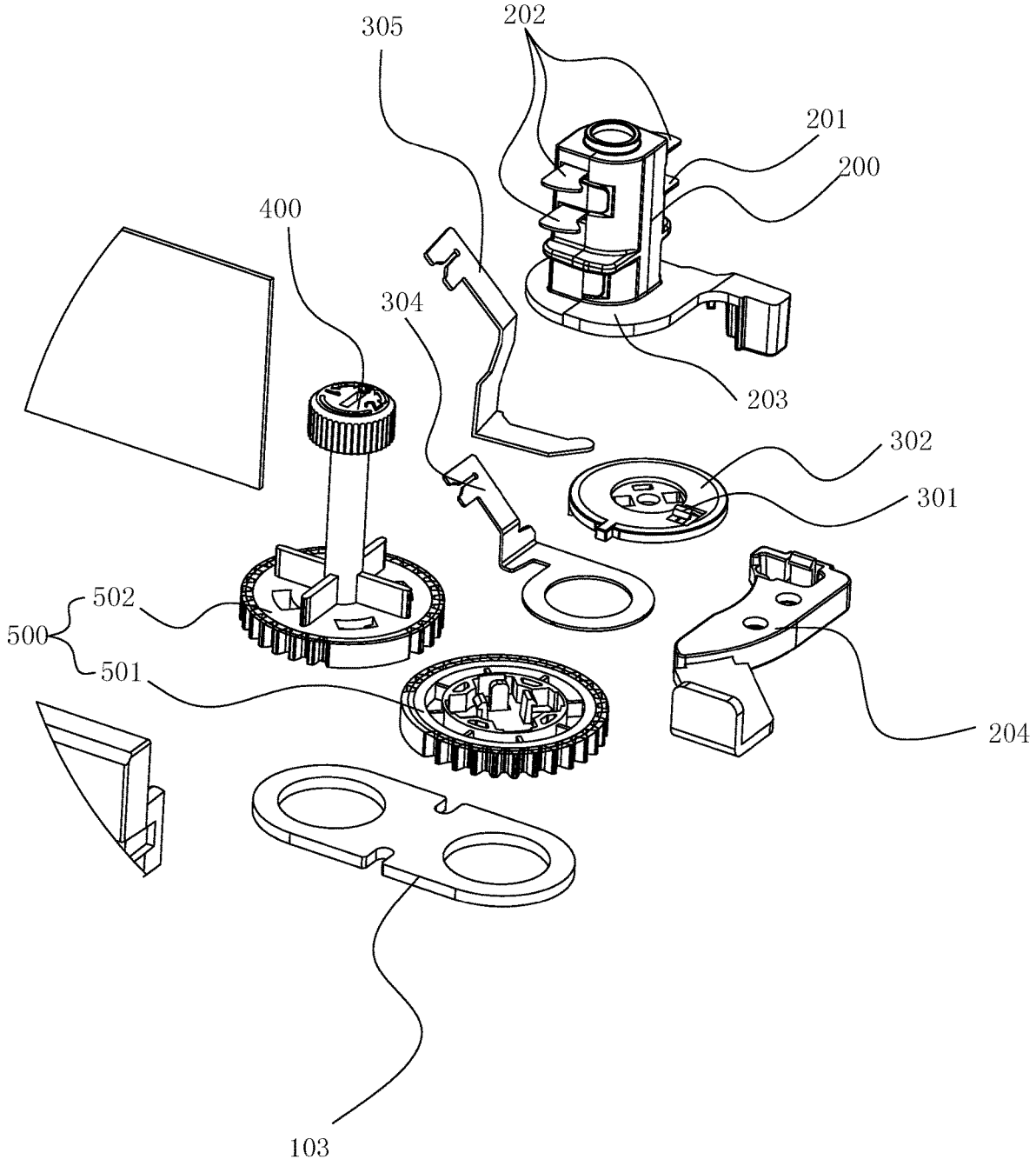
FIG. 3 is an enlargement diagram of the part A in FIG. 2.
Figure 4:
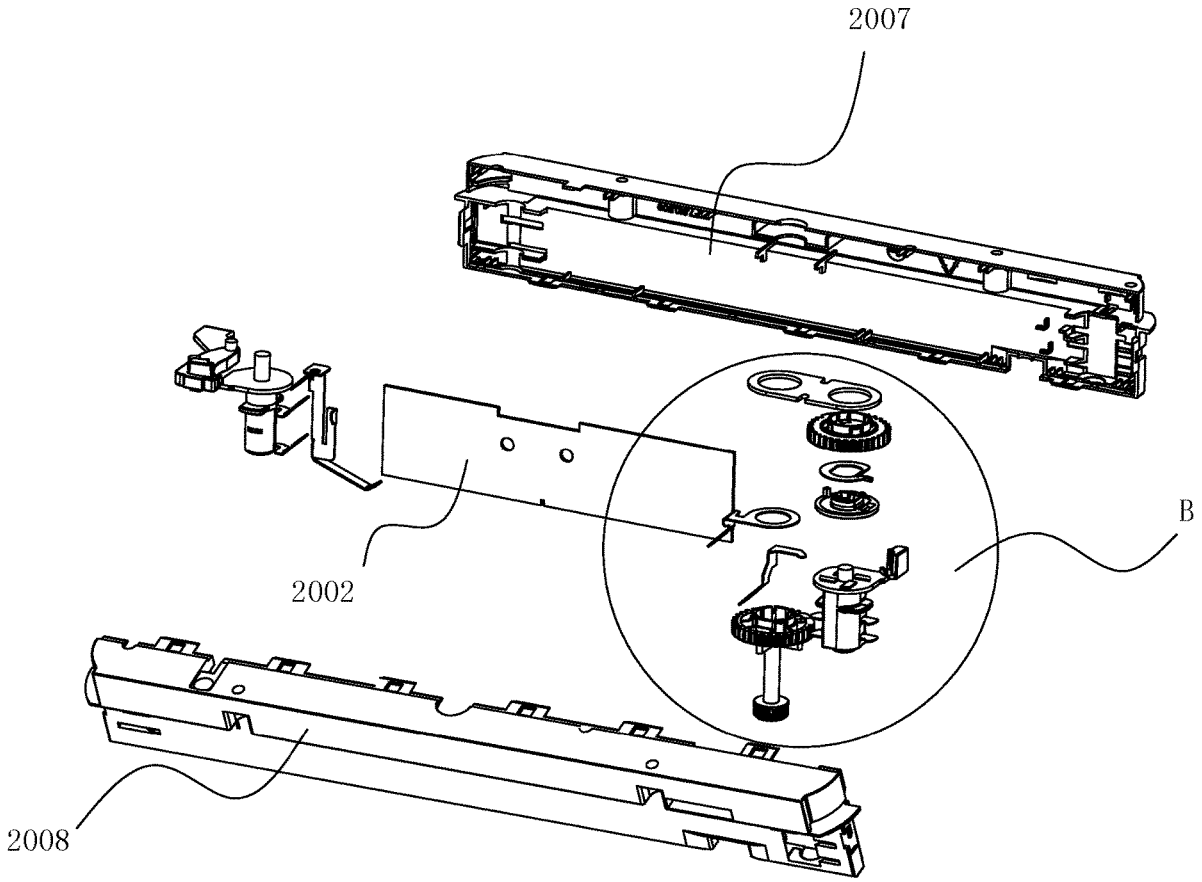
FIG. 4 is an explosive structure of the driving power supply of the present embodiment at another angle.
Figure 5:
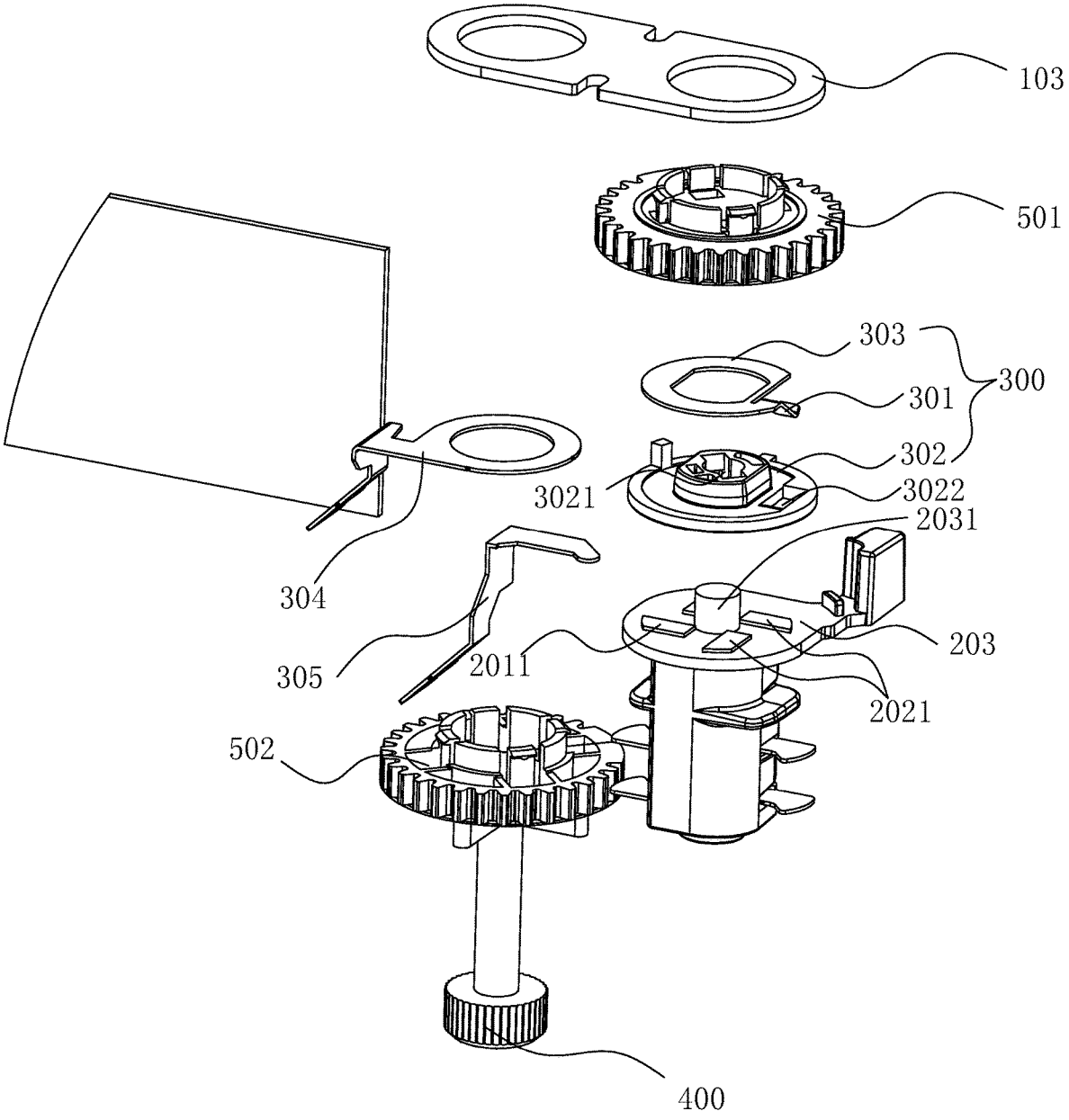
FIG. 5 is the enlargement diagram of the part B in FIG. 4.
Figure 6:
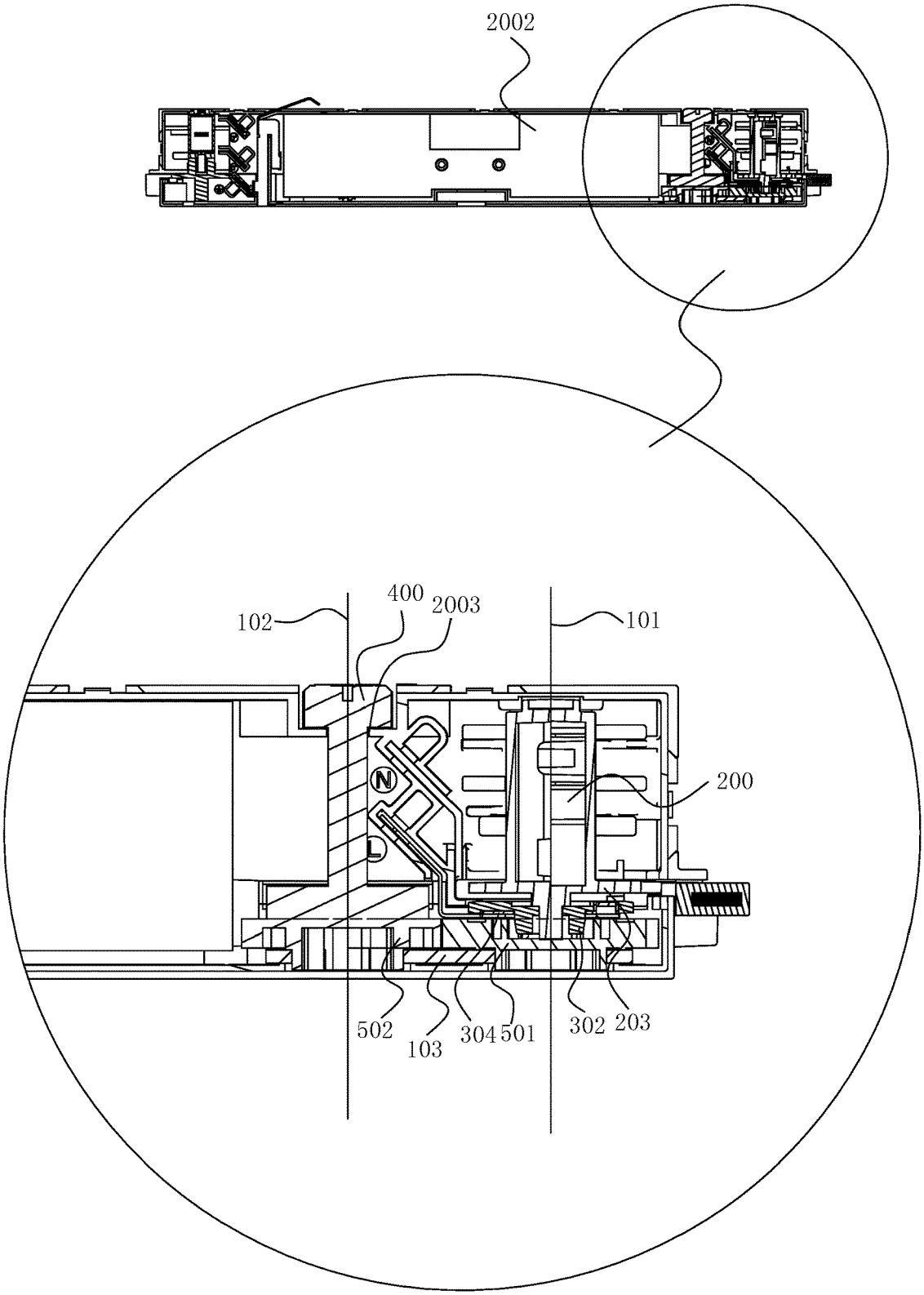
FIG. 6 is a cross-sectional structure of the driving power supply of the present embodiment.
Figure 7:
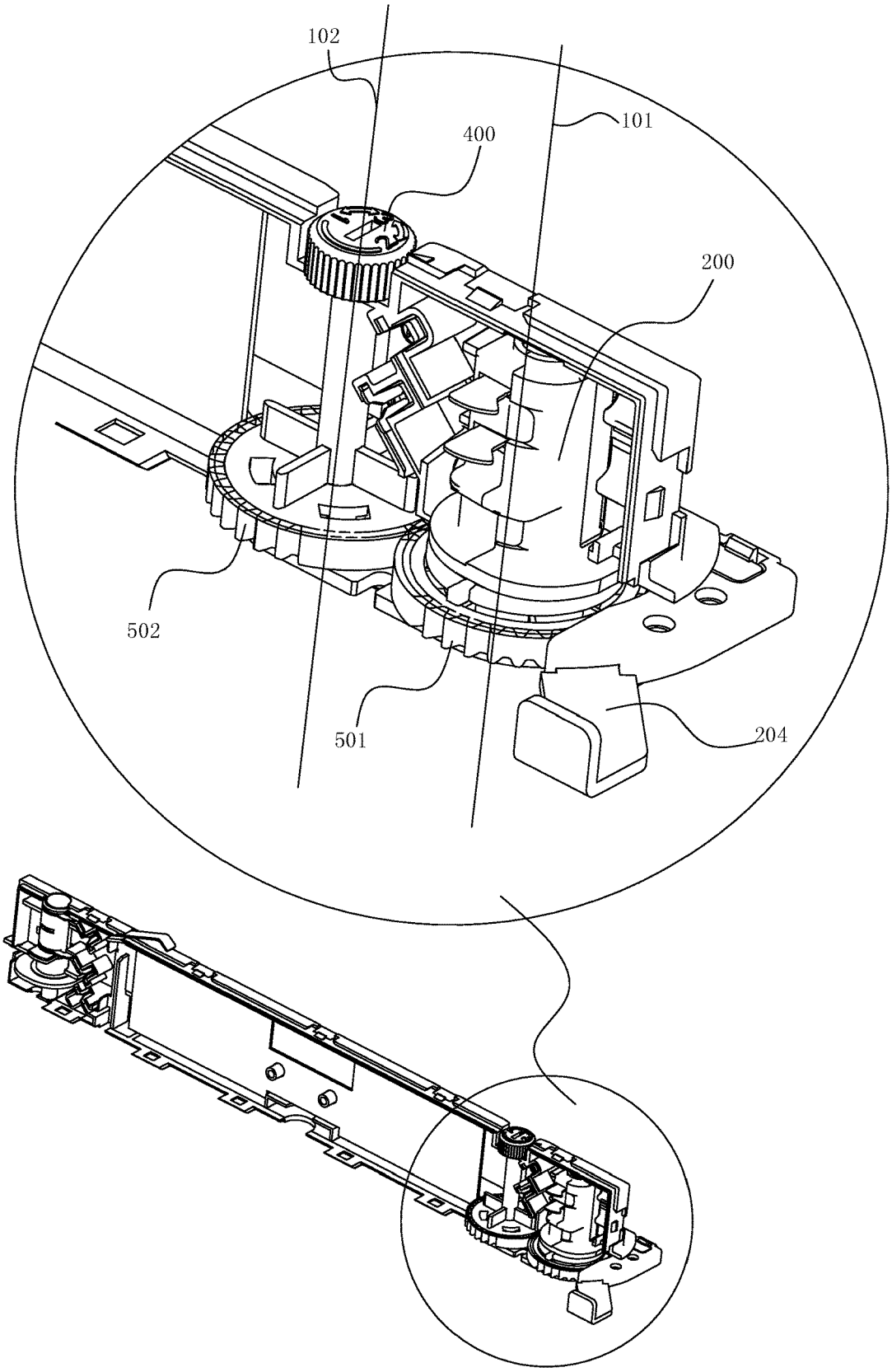
FIG. 7 is a structural diagram of a driving power supply (portion of the power supply housing is removed) for the present embodiment.
Figure 8:
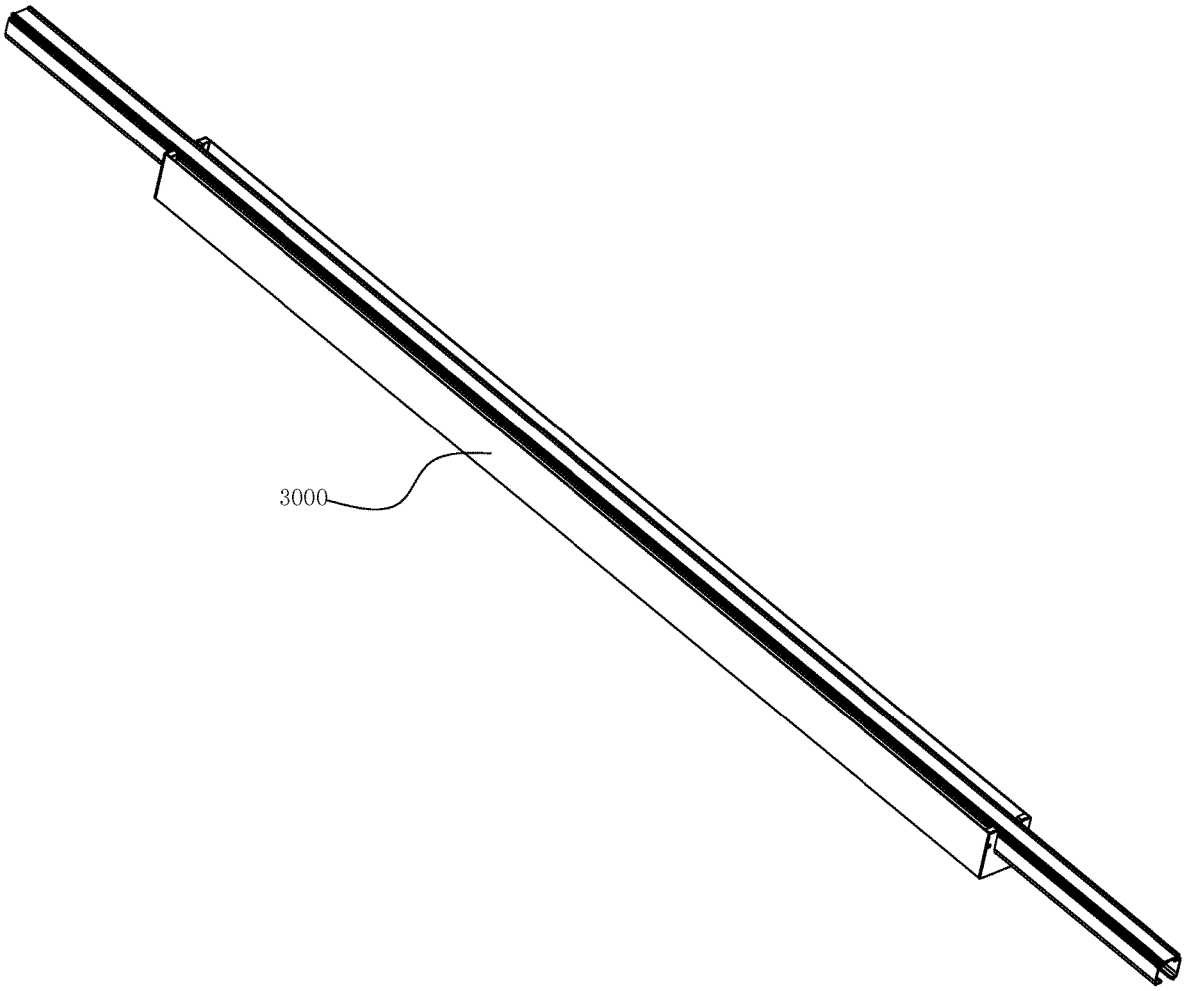
FIG. 8 is a structural diagram of the track light which is mounted on the track of the present embodiment.
Figure 9:
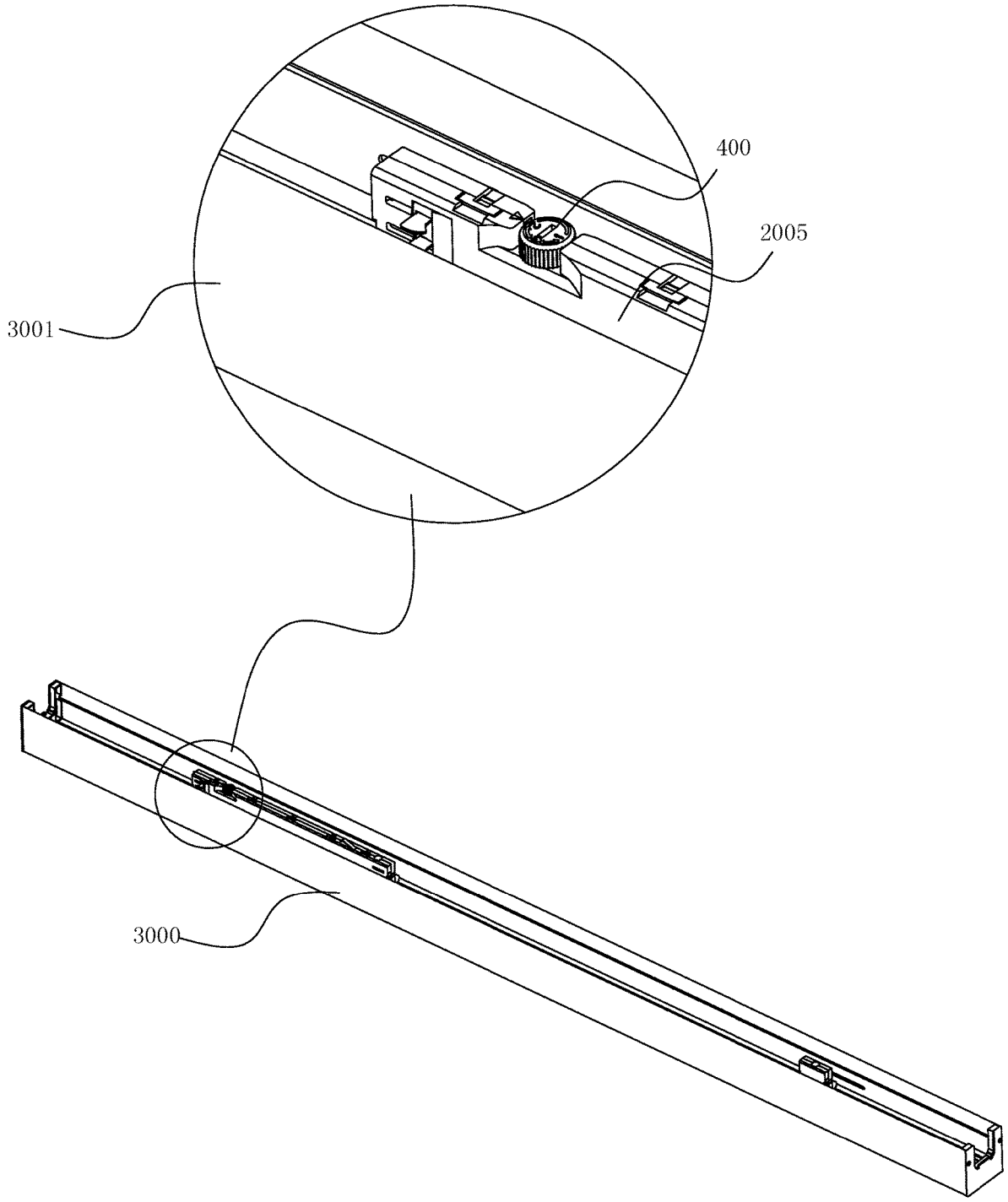
FIG. 9 is a structural diagram of the track light of the present embodiment.
Figure 10:
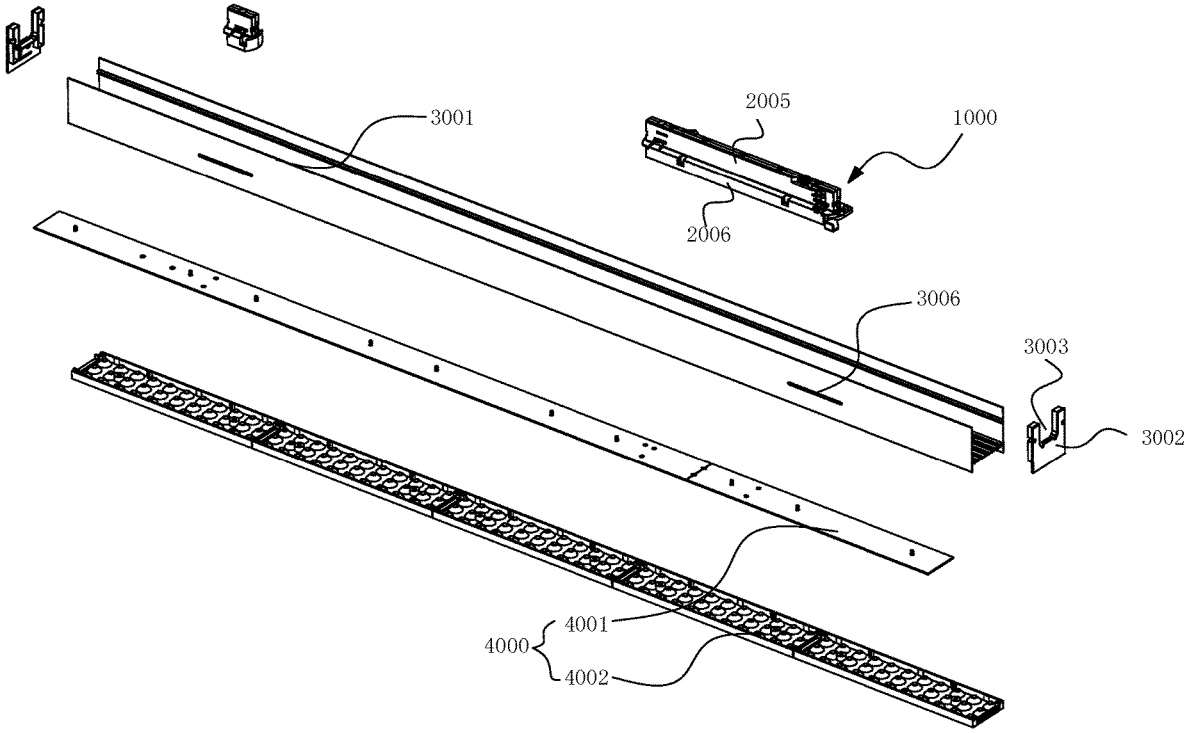
FIG. 10 is an explosive structure of the track light of the present embodiment.

As shown in FIG. 1~10, the track adapter 1000 of the present invention can be used singly or can be integrated with the driving power supply, as long as the housing of the driving power supply is defined as the mounting seat 100 of the present invention for fixing and mounting other components of the track adapter 1000, and the remaining structure is unchanged. When the track adapter 1000 is used alone, it is connected to the light fixture or the positive and negative poles of a separate driving power supply. This embodiment is illustrated with integration as an example.

The driving power supply 2000 of the present embodiment includes a power supply housing 2001 and a circuit board 2002 and a track adapter 1000 disposed in the power supply housing.

The track adapter 1000 can be independent while the power supply housing 2001 and the circuit board 2002 are removed. The track adapter 1000 of the present embodiment includes a mounting seat 100, an electrical supply column 200, a adjustment conductive portion 300, a adjustment knob 400, and a drive mechanism 500. The mounting seat 100 is used to carry other components, the mounting seat 100 is the power supply housing 2001 itself or a component manufactured for manufacturing and mounting. In the present embodiment, the mounting seat 100 includes a power supply housing 2001 and a mounting piece 103 fixed to the power supply housing 2001. The mounting seat 100 has a first central axis 101, and the electrical supply column 200 is rotated around the first central axis 101 and arranged on the mounting seat 100. The electrical supply column 200 is taken as a structure matched with the track, which can be inserted into the track groove and realizes the electric connection after rotation. The electrical supply column 200 is provided with a negative electrode conductive sheet 201 and at least two positive electrode conductive sheets 202. In the present invention, the negative electrode and positive electrode are defined as: L and N are the symbols in alternating current, L is the "fire line" of single-phase alternating current, that is the positive pole, N is the "zero line" of single-phase alternating current, that is the negative pole, and in direct current, "+" represents the positive electrode and "−" represents the negative electrode. For multi-wire orbit of the existing technology, such as four wire track, as standard parts, which are generally U-shaped profiles and a plurality of card slots extending on both sides of the U-profile for arranging conductive metal strips L1, conductive metal strip L2, the conductive metal strip L3, and the conductive metal strip N. The conductive metal strips can be arranged on a separate side, there are other schemes such as the conductive metal strips in different quantities are set on both sides, which are prior art and will not be described. The negative electrode conductive sheet 201 and the positive electrode conductive sheet 202 on the electrical supply column 200 can be set correspondingly. The electrical supply column 200 is extended into the track and rotated to realize the connection and conduction of the negative electrode conductive sheet 201 and the positive electrode conductive sheet 202 with the corresponding conductive metal strip.

The negative electrode conductive sheet 201 needs to be contacted, and it needs to choose one of the positive electrode conductive sheet 202 to conduct, the specific mode is as follows: the positive electrode conductive sheet 202 extends to the bottom of the electrical supply column 200 forming a positive electrode contact 2021, and the positive electrode contacts 2021 are arranged around the first central axis 101 at interval; the adjustment conductive portion 300 is located at the bottom of the electrical supply column 200, and is rotated around the first central axis 101 and arranged on the mounting seat 100, and is provided with a conductive contact 301 in flexible connection with the bottom of the electrical supply column 200. The moving path of the conductive contact 301 passes through the positive electrode contacts 2021. When the electrical supply column 200 is rotated to connect with the track, the conductive contact 301 conducts with one of the positive contact 2021, that is, it conducts with the corresponding conductive metal strip. The flexible connection is abutting connection or a combination of a plug-in and an annular groove. In order to make the conductive contact 301 in conduct with different positive electrode contacts 2021, the adjustment knob 400 is rotatable and arranged on the mounting seat 100 and located on the outside of the top of the electrical supply column 200. The drive mechanism 500 is used to realize the drive connection between the adjustment knob 400 and the adjustment conductive portion 300. Turn the adjustment knob 400, the drive mechanism 500 transmits the stroke of the adjustment knob 400 to the adjustment conductive portion 300, and the adjustment conductive portion 300 rotates to the designed position, when the electrical supply column 200 is rotated in place, it will conduct with the required conductive metal strip.

The adjustment knob 400 of the present embodiment is arranged outside the top of the electrical supply column 200 facilitating manual adjustment, particularly when the track adapter 1000 is installed in a deep narrow structure. To facilitate external connection, the adjustment conductive portion 300 further includes a positive electrode conductive connector 304 and a negative electrode conductive connector 305 which are fixedly arranged. The positive electrode conductive connector 304 maintains a constant conduction with the conductive contact 301, in this embodiment, the positive electrode conductive connector 304 maintains a constant conduction with the conductive contact 301 through a conductive ring. When the negative electrode conductive sheet 201 is rotated to the position connected with the track, the negative electrode conductive connector 305 is in conduction with the negative electrode conductive sheet 201.

The drive mechanism 500 is realized in many forms, such as thread drive, gear transmission, rack transmission, etc. In this embodiment, in order to simplify and facilitate manufacture, the mounting seat 100 is provided with a second central axis 102 parallel to the first central axis 101. The drive mechanism 500 includes a first drive gear 501 and a second drive gear 502. The first drive gear 501 is located at the bottom of the electrical supply column 200 and fixedly connected to the adjustment conductive portion 300, and its gear shaft is coincidence with the first central axis 101; the second drive gear 502 is engaged with the first drive gear 501 and is rotatable around the second central axis 102 and arranged on the mounting seat 100. The adjustment knob 400 is fixed to the second drive gear 502, and the mounting piece 103 are provided with two mounting holes for arranging the first drive gear 501 and the second drive gear 502, where rotational connection is realized through buckle structure.

In order to make the conductive contact 301 and positive electrode contact 2021 conduct stably, the bottom of the electrical supply column 200 is radially expanded to form a conductive plate 203. The positive electrode contact 2021 is a sheet attached to the bottom surface of the conductive plate 203, and the conductive contact 301 abuts against the bottom surface of the conductive plate 203. The large contact area of the sheet structure can avoid the connection instability caused by manufacturing and assembly errors.

The negative electrode conductive sheet 201 is different from the positive electrode conductive sheet 202, and it does not need to choose, only needs to wait for the electrical supply column 200 to rotate in place. In order to facilitate integral production, the negative electrode conductive sheet 201 extends to the bottom of the electrical supply column 200 to form a negative electrode contact 2011. In the present embodiment, the negative electrode contacts 2011 and the positive electrode contact 2021 are arranged on the same surface and arranged together.

The structure of the adjustment conductive portion 300 is fitting with the bottom of the electrical supply column 200. In this embodiment, the adjustment conductive portion 300 includes an adjustment plate 302 and an annular conductive plate 303. The adjustment plate 302 is provided with a shaft hole 3021 in the middle, and the plate surface of the adjustment plate 302 is face against to the positive electrode contact 2021 on the bottom surface of the conductive plate 203 and a through hole 3022 is provided on the plate surface. The middle of the bottom surface of the conductive plate 203 is provided with a rotating shaft 2031 that cooperates with the shaft hole 3021; the annular conductive plate 303 is arranged on the bottom surface of the adjustment plate 302, being with a conductive shrapnel passing through the through hole 3022 as the conductive contact 301 thereon.

This embodiment is used to cooperate with a four-wire rail of a common standard member. There are three positive electrode conductive sheets 202 in this embodiment and they are correspondingly connected to the conductive metal strip L1, and the conductive metal strip L2, the conductive metal strip L3 respectively.

In order to facilitate manual installation, in the present embodiment, the electrical supply column 200 is provided with a protruding rotating handle 204.

The above-described track adapter 1000 can be produced independently, manufactured, and mounted. In this embodiment it is integrated into the driving power supply, specifically, the mounting seat 100 is fixed to the power supply housing 2001, and the power supply housing 2001 is spliced by the left portion 2007 and the right portion 2008. The positive electrode conductive connector 304 is connected to the positive input end of the circuit board 2002, the negative electrode conductive connector 305 is connected to the negative input end of the circuit board 2002, and the connection method is inserted or welded.

The mounting seat 100, the adjustment column 200, the adjustment conductive portion 300 and the drive mechanism 500 are disposed in the power supply housing 2001. The top of the power supply housing 2001 is provided with a mounting hole for the adjustment knob 400 passing through, and at least one side of the power supply housing 2001 is provided with an electrical supply hole 2004 that is provided for the negative electrode conductive sheet 201 and the positive electrode conductive sheet 202 passing through. There are three positive electrode conductive sheet 202, which is grouped together in pairs with the negative electrode conductive sheet 201 and arranged on both sides of the electric column 200. The power supply housing 2001 are provided with an electrical supply hole 2004 on both sides.

The track adapter 1000 of this embodiment is particularly useful for the track light of the present embodiment, and the track light includes a lamp holder 3000. The lamp holder 3000 is provided with a light source assembly 4000, a driving power supply 2000, and a track adapter 1000. The lamp holder driving power supply includes a power supply housing 2001 and a circuit board 2002 disposed in the power supply housing, the mounting seat 100 is fixed to the power supply housing 2001, the positive electrode conductive connector 304 is connected to the positive input end of the circuit board 2002, and the negative electrode conductive connector 305 is connected to the negative input end of the circuit board 2002.

The lamp holder of the present embodiment wraps the whole track, which is neat and beautiful. The lamp holder 3000 includes an U-profile 3001 with opening upward and an end cover 3002 provided at both ends of the U-profile 3001. The light source assembly 4000 is arranged on the outer side of the U-profile 3001, the track adapter 1000 is arranged in the bottom of the U-profile 3001; the end cover 3002 is provided with a notch 3003 that avoids the track.

In order to facilitate the installation of the light source assembly 4000, the two side of the U-profile 3001 extends downward. The light source assembly 4000 including a lamp plate 4001 and an optical element 4002.

The power supply housing 2001 includes a lower portion 2006 and an upper portion 2005 inserted into the track. The mounting seat 100, a electrical supply column 200, and the adjustment conductive portion 300 and the drive mechanism 500 are disposed in the power supply housing 2001; The top of the upper portion 2005 is provided with a mounting hole 2003 for the adjustment knob 400 exposing, and the two sides are provided with the electrical supply hole 2004 that provided for the negative electrode conductive sheet 201 and the positive electrode conductive sheet 202 passing through.

The upper portion 2005 is stuck in the track, and the width of the lower portion 2006 is larger than the upper portion 2005, for facilitating the drive mechanism 500, for receiving the mounting seat 100, the drive mechanism 500.

The electrical supply column 200 is provided with a rotating handle 204 extending out of the power supply housing 2001, and the side wall of the U-profile 3001 is provided with a strip hole 3006 where the rotating handle 204 passes through.

The preferred embodiments of the present invention are not intended to limit the scope of the invention, any modifications, equivalents or modifications in the spirit of the present invention, are included in the claims.

What is claimed is:

1. A track adapter (1000), comprising:

a mounting seat (100), having a first central axis (101);

an electrical supply column (200), rotated around the first central axis (101) and arranged on the mounting seat (100), and provided with a negative electrode conductive sheet (201) and at least two positive electrode conductive sheets (202) on its column body, and the positive electrode conductive sheets (202) extend to a bottom of the electrical supply column (200) forming positive electrode contacts (2021), and the positive electrode contacts (2021) are arranged around the first central axis (101) at intervals;

further comprising:

an adjustment conductive portion (300), located at the bottom of the electrical supply column (200), and rotated around the first central axis (101) and arranged on the mounting seat (100), provided with a conductive contact (301) in flexible connection with the bottom of the electrical supply column (200), and a moving path of the conductive contact (301) passes through the positive electrode contacts (2021);

an adjustment knob (400), which is rotatable and arranged on the mounting seat (100) and located on the outside of the top of the electrical supply column (200);

and a drive mechanism (500), which is used to connect the adjustment knob (400) and the adjustment conductive portion (300).

2. The track adapter (1000) as claimed in claim 1, wherein the adjustment conductive portion (300) further comprises:

a positive electrode conductive connector (304), which maintains a constant conduction with the conductive contact (301);

a negative electrode conductive connector (305), and the negative electrode conductive connector (305) is in conduction with the negative electrode conductive sheet (201) when the negative electrode conductive sheet (201) is rotated to a position connected with a track.

3. The track adapter (1000) as claimed in claim 2, wherein the mounting seat (100) is provided with a second central axis (102) parallel to the first central axis (101), the drive mechanism (500) comprises:

a first drive gear (501), which is located at the bottom of the electrical supply column (200) and connected to the adjustment conductive portion (300), and its gear shaft is coincident with the first central axis (101);

a second drive gear (502), which is engaged with the first drive gear (501) and is rotatable around the second central axis (102) and arranged on the mounting seat (100), and the adjustment knob (400) is fixed to the second drive gear (502).

4. The track adapter (1000) as claimed in claim 2, wherein the bottom of the electrical supply column (200) is radially expanded to form a conductive plate (203), and each of the positive electrode contacts (2021) is a sheet attached to a bottom surface of the conductive plate (203), and the conductive contact (301) abuts against the bottom surface of the conductive plate (203).

5. The track adapter (1000) as claimed in claim 2, wherein the negative electrode conductive sheet (201) extends to the bottom of the electrical supply column (200) to form a negative electrode contact (2011).

6. The track adapter (1000) as claimed in claim 4, wherein the adjustment conductive portion (300) comprises:

an adjustment plate (302), provided with a shaft hole (3021) in the middle, and a plate surface of the adjustment plate (302) is faced against the positive electrode contacts (2021) on the bottom surface of the conductive plate (203) and a through hole (3022) is provided on the plate surface, and the middle of the bottom surface of the conductive plate (203) is provided with a rotating shaft (2031) that cooperates with the shaft hole (3021);

and an annular conductive plate (303), which is arranged on the bottom surface of the adjustment plate (302), being with a conductive shrapnel passing through the through hole (3022) as the conductive contact (301) thereon.

7. The track adapter (1000) as claimed in claim 2, wherein there are three positive electrode conductive sheets (202).

8. The track adapter (1000) as claimed in claim 2, wherein the electrical supply column (200) is provided with a protruding rotating handle (204).

9. A driving power supply (2000) comprising a power supply housing (2001) and a circuit board (2002) disposed in the power supply housing (2001), further comprising the track adapter (1000) as claimed in claim 2, wherein the mounting seat (100) is fixed to the power supply housing (2001), the positive electrode conductive connector (304) is connected to a positive input end of the circuit board (2002), and the negative electrode conductive connector (305) is connected to a negative input end of the circuit board (2002).

10. The driving power supply (2000) as claimed in claim 9, wherein the mounting seat (100), the adjustment column (200), the adjustment conductive portion (300) and the drive mechanism (500) are disposed in the power supply housing (2001), a top of the power supply housing (2001) is provided with a mounting hole for the adjustment knob (400) passing through, and at least one side of the power supply housing (2001) is provided with an electrical supply hole (2004) that is provided for the negative electrode conductive sheet (201) and the positive electrode conductive sheet (202) passing through.

11. The driving power supply (2000) as claimed in claim 9, wherein there are three positive electrode conductive sheets (202), which is grouped together in pairs with the negative electrode conductive sheet (201) and arranged on both sides of the electric column (200), and the power supply housing (2001) are provided with an electrical supply hole (2004) on both sides.

12. A track light comprises a lamp holder (3000), wherein a light source assembly (4000), a driving power supply (2000), and the track adapter (1000) as claimed in claim 2 are arranged on the lamp holder (3000).

13. The track light as claimed in claim 12, wherein the lamp holder driving power supply includes a power supply housing (2001) and a circuit board (2002) disposed in the power supply housing, the mounting seat (100) is fixed to the power supply housing (2001), the positive electrode conductive connector (304) is connected to the positive input end of the circuit board (2002), and the negative electrode conductive connector (305) is connected to the negative input end of the circuit board (2002).

14. The track light as claimed in claim 12, wherein the lamp holder (3000) includes a U-profile (3001) with a opening upward and an end cover (3002) provided at both ends of the U-profile (3001), and the light source assembly (4000) is arranged on the outer side of the U-profile (3001), the track adapter (1000) is arranged in the bottom of the U-profile (3001); the end cover (3002) is provided with a notch (3003) that avoids the track.

15. The track light as claimed in claim 12, wherein the power supply housing (2001) comprises a lower portion (2006) and an upper portion (2005) inserted into the track; the mounting seat (100), a electrical supply column (200), and the adjustment conductive portion (300) and the drive mechanism (500) are disposed in the power supply housing (2001); the top of the upper portion (2005) is provided with a mounting hole (2003) for exposing the adjustment knob (400), and the two sides are provided with the electrical supply hole (2004) that provided for passing through the negative electrode conductive sheet (201) and the positive electrode conductive sheet (202).

16. The track light as claimed in claim 15, wherein the width of the lower portion (2006) is greater than the upper portion (2005), for facilitating the drive mechanism (500), for receiving the mounting seat (100), the drive mechanism (500).

17. The track light as claimed in claim 12, wherein the electrical supply column (200) is provided with a rotating handle (204) extending out of the power supply housing (2001), and the side wall of the U-profile (3001) is provided with a strip hole (3006) where the rotating handle (204) passes through.

* * * * *